US005829999A

United States Patent [19]

Macleod

[11] Patent Number: 5,829,999

[45] Date of Patent: Nov. 3, 1998

[54] METHOD AND APPARATUS FOR SECURING THE CONTINUITY OF A POWER SUPPLY TO AN ELECTRICAL APPLIANCE

[75] Inventor: Stuart Bruce Macleod, Sandton, South Africa

[73] Assignee: Gregory Jay Whatmore, Harmelia Edenvale, South Africa

[21] Appl. No.: 721,142

[22] Filed: Sep. 26, 1996

[30] Foreign Application Priority Data

Sep. 27, 1995 [ZA] South Africa ..... 95/8107

[51] Int. Cl.[6] ..... H01R 4/50

[52] U.S. Cl. ..... 439/346; 439/102

[58] Field of Search ..... 439/102, 346, 439/359, 135, 299, 265, 270; 200/43.01, 50.28, 50.31, 333

[56] References Cited

U.S. PATENT DOCUMENTS

| | | | |
|---|---|---|---|
| 2,674,722 | 4/1954 | Hubell et al. | 339/14 |
| 2,683,864 | 7/1954 | Hubbell et al. | 339/14 |
| 2,872,654 | 2/1959 | Smith | 339/14 |
| 3,890,025 | 6/1975 | Gray | 339/14 |
| 4,111,509 | 9/1978 | Novak | 439/102 |
| 4,199,207 | 4/1980 | Lee | 339/14 |
| 5,480,318 | 1/1996 | Garrison | 439/346 |
| 5,582,180 | 12/1996 | Manset et al. | 439/135 |

FOREIGN PATENT DOCUMENTS

| | | |
|---|---|---|
| 1142020 | 6/1959 | Germany . |
| 812399 | 7/1957 | United Kingdom . |
| 2 193 047 | 1/1988 | United Kingdom . |

*Primary Examiner*—Neil Abrams
*Assistant Examiner*—Tho Dac Ta
*Attorney, Agent, or Firm*—Woodcock Washburn Kurtz Mackiewicz & Norris LLP

[57] ABSTRACT

An electrical pin 230 has an elongate body which is receivable in a complementary socket of an existing electrical outlet, while two electrically conductive pins on the same plug are simultaneously receivable in respective sockets for establishing a power supply path for an electrical appliance. A resilient deformable ring 238 is held captive by the body of the pin 230. Two metal spheres 234 bearing respectively against an inner peripheral region of the ring 238 lie in a transverse passage 233 extending through the body of the pin 230. A screw 236 lying in a threaded passage 231 intersecting the transverse passage 233 bears against the spheres 234. In use the screw 236 urges the spheres radially outwardly, thereby expanding the ring 238 until it bears frictionally against an adjacent portion of an associated electrical socket. The pin 230 is preferably mounted in an insulating body (not shown) having a switch cover 38 projecting from the body in lateral relationship to the pin. In use the switch cover 38 denies unauthorized access to an electrical switch 39 located adjacent to the socket which receives the pin 230.

24 Claims, 3 Drawing Sheets

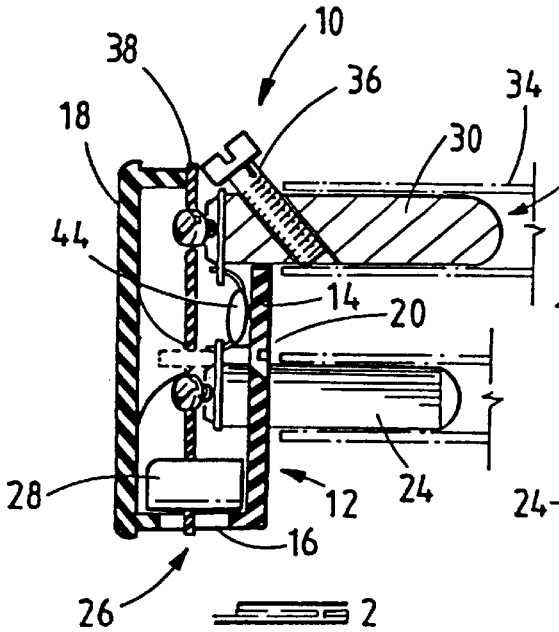
2
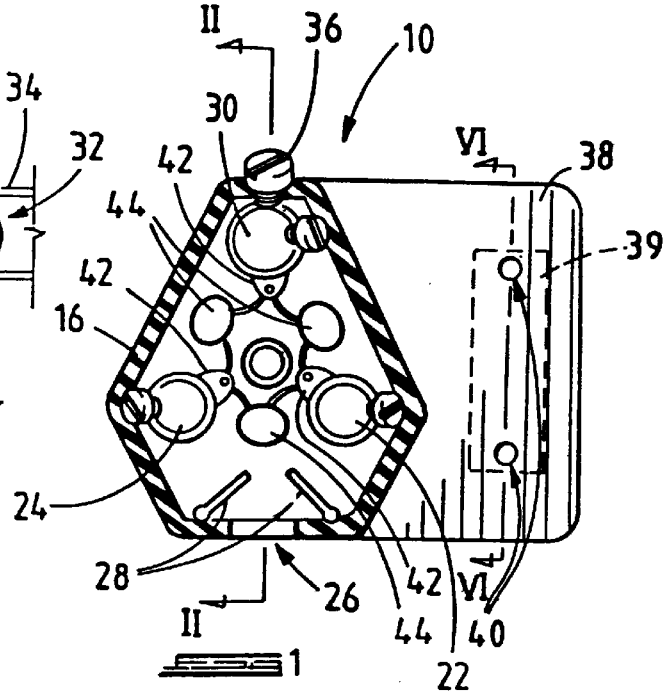
1
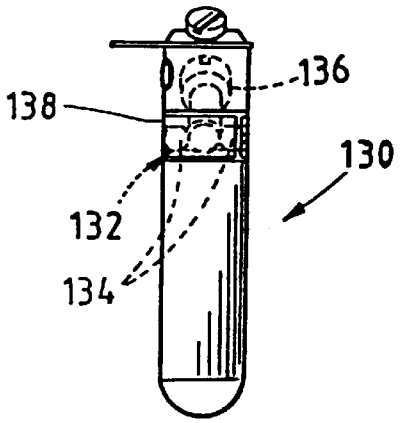
3

METHOD AND APPARATUS FOR SECURING THE CONTINUITY OF A POWER SUPPLY TO AN ELECTRICAL APPLIANCE

FIELD OF THE INVENTION

This invention relates to a method of securing a continuous power supply to an electrical appliance. The invention extends to an electrical plug and, specifically, to any non-conducting locating formation on the plug, which is receivable in a complementary socket of a chosen electrical outlet.

BACKGROUND TO THE INVENTION

Most commercially available electrical appliances are equipped with flexible electrical cords and plugs for drawing power from an electrical mains supply through complementary outlets. These outlets are usually equipped with switches for optionally interrupting the supply of electricity to the respective appliances.

Certain electrical appliances such as video cassette recorders rely on built-in, electrically driven clocks to operate according to a predetermined schedule. Any power interruption will accordingly disrupt the desired operation of the appliance, particularly when it does not have an electrical backup system of its own.

Other appliances such as burglary protection systems or personal computers require a continuous supply of electricity for operating in a standby mode. Any uncontrolled power interruptions will obviously defeat the normal operation of these appliances.

These interruptions may be attributable to inadvertent switching off of the power supply at a given socket. In other instances the plug of the affected appliance may be withdrawn either deliberately or unintentionally from its socket.

The present invention is directed at counteracting power interruptions of this nature.

SUMMARY OF THE INVENTION

The present invention provides method of securing the continuity of a power supply to an appliance having an electrical cord connected to a plug having at least a pair of electrically conductive pins and a passive pin which are simultaneously receivable in respective sockets of an existing electrical outlet, which includes the steps of

- inserting the conducting pins of the plug into their respective sockets to establish a power supply path along the cord to the appliance; and
- locking the passive pin in its associated socket in order to counteract extraction of the conducting pins from their respective sockets.

The meaning of the term "passive pin" in the context of the present description includes any pin on the plug which does not form part of the normal power supply path to the appliance. This may conveniently be an earthing pin for directing stray electrical currents from the appliance to earth. The meaning of this term extends, however, to any non-conducting locating formation on the plug, which is receivable in a complementary socket of a chosen electrical outlet.

The passive pin may be locked in position by urging a screw along a threaded passage extending obliquely through the passive pin, until the screw bears against an adjacent portion of its associated socket.

More preferably, however, the earthing pin may be locked in position by laterally deforming a resilient frictional element which is held captive by the passive pin until the frictional element bears against an adjacent portion of its associated socket.

The method provided by the present invention may include a further step of restricting access to a switch for interrupting the power supply to an outlet in which the plug is located. This may be done by positioning a cover projecting from the plug over the switch, thereby denying uncontrolled access to the switch.

The invention extends to a plug for securing the continuity of a power supply through an electrical cord to an electrical appliance, which includes

- an insulating body supporting at least a pair of electrically conducting pins for establishing a power supply path along the cord, and a passive pin spaced from the conductive pins, all pins being simultaneously receivable in respective sockets of an existing electrical outlet; and
- a locking means connected to the passive pin, for locking the passive pin in its associated socket to counteract extraction of the conducting pins from their respective sockets.

The locking means may include a screw located in a threaded passage extending in oblique relationship to the earthing pin. The screw is rotatable until it projects partially from a region of the earthing pin where it is capable of bearing against an adjacent portion of an associated electrical socket.

In a preferred embodiment of the invention the locking means may include a displaceable frictional element which is held captive by the earthing pin. The frictional element is conveniently laterally displaceable by means of a screw co-operating directly or indirectly with the frictional element to urge it towards an adjacent portion of an associated electrical socket.

BRIEF DESCRIPTION OF THE DRAWINGS

The invention is described below by way of example in which

FIG. 1 shows an upper plan view of an electrical plug according to the present invention, without a cover, for ease of illustration;

FIG. 2 shows a sectional side elevational view taken along II—II on the plug of FIG. 1;

FIG. 3 shows a side elevational view of a preferred earthing pin, on an enlarged scale, for use in conjunction with a plug, similar to that of FIG. 1;

DESCRIPTION OF A PREFERRED EMBODIMENT OF THE INVENTION

Figure 4:
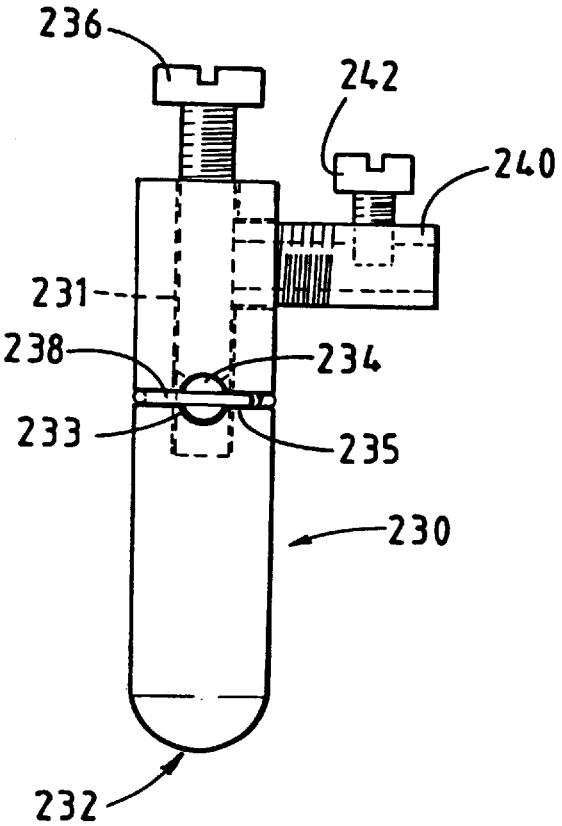
FIG. 4 shows a side elevational view of a particulary preferred earthing pin, on an enlarged scale, for use in conjunction with a plug similar to that of FIG. 1.

In FIGS. 1 and 2 reference numeral 10 generally denotes an electrical plug according to the present invention. The plug 10 has a moulded plastic body 12 comprising a base plate 14 and upstanding edges 16. The plug 10 is generally symmetrical about the sectional reference line II—II shown in FIG. 1.

A complementary moulded plastic cover 18 fits on the upstanding edges 16, and is held in position by a locking screw 20, which passes through the base plate 14. The cover 18 is omitted from FIG. 1 to reveal the internal components of the plug 10.

Two brass pins 22 and 24 of substantially similar dimensions pass through the base plate 14. The pins 22 and 24 lie in perpendicular relationship to the base plate 14, and are arranged in symmetrical relationship to the reference line II—II. The pins 22 and 24 are respectively connectible in known fashion to a live and a neutral conductor of an electrical cord (not shown).

In use the cord passes through an aperture 26 between a pair of resilient, opposing locking plates 28 which are held captive by the body 12. The plates 28 are biased towards each other to grip the cord between them, thereby providing strain relief on the conductor connections within the body 12 whenever the cord is subjected to any external tension. The features described thus far are generally found with relatively minor adaptations in numerous commercially available electrical plugs.

The plug 10 further includes an elongate, metal earthing pin 30 spaced from the pins 22 and 24. A portion of the pin 30 lies within the body 12, and is connectible to the earth conductor of a commercially available electrical cord of the kind mentioned above.

The unconnected end 32 of the pin 30 projects from the body 12, and is slidingly receivable in a closely fitting metal sleeve 34 of an existing domestic electrical outlet (not further illustrated).

A threaded passage extends through the pin 30 in oblique relationship to its longitudinal axis. The openings to this passage lie on either side of the base plate 14. A locking screw 36 fitting into the oblique passage through the pin 30 is optionally rotatable by means of a screwdriver (not shown). The head of the screw 36 may be adapted to fit a customized tool to limit any unauthorized access.

In use the plug 10 is inserted into a selected electrical outlet for receiving the pins 22, 24 and 30 in known fashion. The screw 36 is then rotated until its tip bears against an adjacent portion of the sleeve 34. The frictional contact between the screw 36 and the sleeve 34 safeguards the plug 10 against inadvertent removal, and against unauthorized removal by persons not having the appropriate tool.

The plug is made even more effective against undesired power interruptions on an associated appliance by providing a switch cover 38 which is sandwiched between the body 12 and the cover 18 of the plug, as shown in FIG. 2. A portion of the cover 38 projects laterally from the body 12, extending across the usual location of an electrical switch 39.

When the plug 10 is locked in position in the manner described above, the cover 38 simultaneously denies other users normal access to the switch 39 for interrupting the power supply to the plug 10. A pair of apertures 40 is conveniently provided for inserting a rod or similar tool for optionally activating or deactivating the switch by depressing the appropriate switch portion.

The plug 10 is conveniently provided with 3 soldering terminals 42 which are respectively crimped on to each of the pins 22, 24 and 30. Three commercially available metal oxide varistors 44 are connected between each pair of terminals 42, and lie within the body 12, adjacent to the base plate 14.

The varistors 44 are designed to protect appliances connected to the plug 10 against spurious overvoltage conditions. The varistors 44 are conveniently arranged to minimize any interfere with the normal connection of electrical conductors to their respective pins 22, 24 and 30.

FIG. 3 shown an earthing pin 130 which is usable in similar fashion as the pin 30. The pin 130 has the same general external dimensions as the pin 30. The pin 130 has a corresponding oblique, threaded passage which in use commences above the base plate 14, and terminates in a transverse passage 132 extending across the diameter of the pin 130.

A pair of metal spheres 134, only one of which is visible in FIG. 3, is located in the passage 132. A locking screw 136 lying in the oblique passage is arranged between the spheres 134. In use the screw 136 urges the spheres away from each other, and against a split ring 138, which is held captive on the cylindrical portion of the pin 130 in a corresponding groove.

The ring 138 is manufactured of a resilient metal, and is dimensioned so that in its relaxed state it does not protrude beyond the general outer surface of the cylindrical portion of the pin 130. This permits a plug equipped with the pin 130 to be inserted in an available electrical socket in known fashion.

When the plug is in place, the locking screw 136 is operated in the manner described above to expand the ring 138 until it bears frictionally against an adjacent portion of its associated socket. The plug is hence similarly safeguarded against undesired removal.

Figure 5:
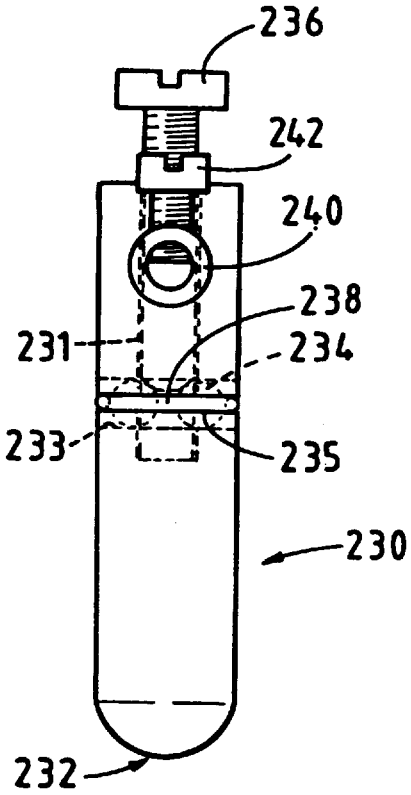
FIG. 5 shows a front elevational view of the pin of FIG. 4.
Figure 6:
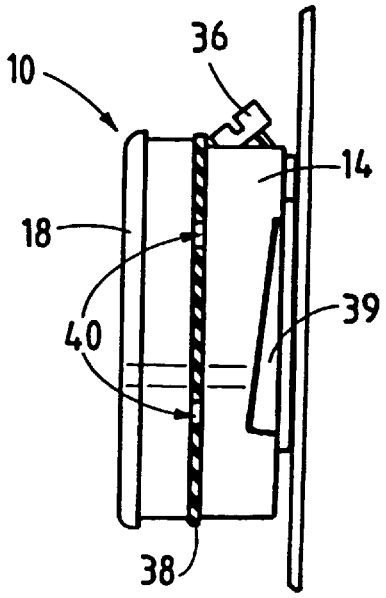
FIG. 6 shows a sectional view in side elevation taken along VI—VI on the plug of FIG. 1, in use.

FIGS. 4 and 5 depict a particularly preferred earthing pin 230 having a longitudinal metal body of circular cross section, terminating in a rounded tip 232. In use the pin 230 conveniently forms part of a plug of the kind illustrated in FIGS. 1 and 2. The pin 230 is accordingly so dimensioned as to fit slidingly into a metal sleeve 34 forming part of an existing electrical mains outlet (FIG. 2).

The pin 230 has an axial, threaded passage 231 extending from the end of the pin furthest from the rounded tip 232 towards an intermediate, transverse passage 233 passing through the body of the pin. The passage 233 intersects a peripheral, radial groove 235 in the outer periphery of the body of the pin 230, roughly mid-way between its ends.

A resilient deformable metal ring 238 nesting in the groove 235 is held captive by the body of the pin 230, thereby confining a pair of metal spheres 234 to the passage 235. The ring 238 in its relaxed state generally lies within the outer peripheral area of the body of the pin 230 to permit insertion of the pin into a corresponding socket of an electrical mains outlet.

The spheres 234 corrspond generally to the sheres 134 of the pin 130 shown in FIG. 3, and fit with minimal lateral clearance into the passage 233. A locking screw 236 which co-operates with the thread of the axial passage 231 has a leading tip abutting against each of the spheres 234.

The spheres 234 simultaneously bear against the inner peripheral region of the ring 238. In use the advancing locking screw 236 accordingly urges the spheres 234 in opposing directions, thereby causing the ring 238 to expand radially until it bears frictionally against an adjacent metal sleeve of an existing electrical mains outlet (not shown).

The pin 230 is conveniently fitted to an electrical plug, such as the plug 10 shown in FIGS. 1 and 2. The head of the locking screw 236 is preferably housed within the plug cover 18, and is accessible through a corresponding aperture (not shown) in the cover. The pluge is hence secured against inadvertent or deliberate extraction from its associated electrical mains for as long as the screw 236 is maintained in its locking position.

The pin 230 is equipped with a partially threaded metal bush 240 which enters the body of the pin by way of a complementary threaded passage extending radially from the axial passage 231. The bush 240 defines a bore 242 for receiving the termination of an existing earth wire (not shown) forming part of an electrical cord connected to an electrical appliance.

A fastening screw 242 fitting into a complementary threaded passage intersecting the bore of the bush 240 provides a convenient means for securing the termination of the earth wire mentioned above in known fashion.

I claim:

1. A method of securing a continuous power supply path to an appliance having an electrical cord connected to a plug having at least a pair of electrically conducting pins and a passive pin which are simultaneously receivable in respective sockets of an existing electrical outlet, which includes the steps of inserting the conducting pins and the passive pin into their respective sockets to establish a power supply path along the cord to the appliance; and displacing a threaded screw lying in a threaded passage through the passive pin such that said threaded screw is interposed between a pair of displaceable elements located in a transverse passage through said passive pin and held captive by a resilient frictional element that is circumferentially held captive on the passive pin by a corresponding groove in the passive pin, such that said pair of displaceable elements are urged apart until said pair of displaceable elements cooperatively bear against an inner surface of said resilient frictional element thereby radially expanding said resilient frictional element beyond an outer peripheral region of the passive pin and towards an adjacent portion of its associated socket in order to counteract extraction of the pins from their respective sockets.

2. The method according to claim 1, wherein said pair of displaceable elements are two metal spheres.

3. The method according to claim 1, wherein said threaded screw is lying in an axial, threaded passage extending from the plug end of the pin such that said threaded screw could be accessed at an angle perpendicular to the plug.

4. The method according to claim 1 which includes the further step of partially shielding an electrical switch associated with the electrical outlet in which the plug is inserted to permit selective access to the switch once the power supply path to the appliance has been established.

5. The method according to claim 1, wherein said resilient frictional element is a deformable metal ring.

6. The method according claim 5, wherein the deformable metal ring is a split ring.

7. A plug for securing a continuous power supply path through an electrical cord to an electrical appliance, which includes an insulating body supporting at least a pair of electrically conducting pins for establishing a power supply path along the cord, and a passive pin spaced from the conductive pins, all pins being simultaneously receivable in respective sockets of an existing electrical outlet;

a passage extending transversely through the passive pin such that two extremities at an outermost peripheral region of the passive pin are respectively defined;

a pair of displaceable elements lying between said extremities of said passage extending transversely through the passive pin;

a resilient frictional element held captive on the passive pin by a corresponding groove and overlying the extremities of the transverse passage through the passive pin thereby holding captive said pair of displaceable elements within said transverse passage; and a locking means on the passive pin, for laterally displacing said pair of displaceable elements in use, until said pair of displaceable elements bear against an inner surface of the frictional element and urges said frictional element towards an adjacent portion of its associated socket, thereby counteracting extraction of the conducting pins and the passive pin from their respective sockets.

8. A plug according to claim 7 in which the insulating body has a shielding means for partially shielding an electrical switch once the conducting pins and the passive pin are located in their respective sockets.

9. A plug according to claim 7, wherein the locking means includes a screw having a threaded shank terminating at a tip, the shank lying in a threaded bore in an oblique passage through the passive pin, with the tip of the screw being located adjacent to each displaceable element to permit lateral displacement of each element as the screw advances into the bore.

10. A plug according to claim 9, wherein said threaded shank of said screw is lying in an axial, threaded passage extending from the plug end, of the pin such that said threaded screw could be accessed at an angle perpendicular to the plug.

11. A passive pin for use on a plug for securing a continuous power supply path through an electrical cord to an appliance, which includes an elongate body which is receivable in a complementary socket of an electrical outlet;

a passage extending transversely through the passive pin such that two extremities at an outermost peripheral region of the passive pin are respectively defined;

a pair of displaceable elements lying between said extremities of said passage extending transversely through the passive pin;

a resilient frictional element held captive on the elongated body, and overlying the extremities of the transverse passage through the body thereby holding captive said displaceable elements within said transverse passage; and locking means for laterally displacing each displaceable element in use until it bears against an inner surface of the frictional element, and urges the frictional element radially outward in relation to the body.

12. The pin according to claim 11, wherein the locking means includes a screw having a threaded shank terminating at a tip, the shank lying in a threaded bore in a passage through the passive pin, with the tip of the screw being located adjacent to each displaceable element to permit lateral displacement of each element as the screw advances into the bore.

13. The pin according to claim 12, wherein said threaded shank of said screw is lying in an axial, threaded passage extending from the plug end of the pin such that said threaded screw could be accessed at an angle perpendicular to the plug.

14. A method of securing a continuous power supply path to an appliance having an electrical cord connected to a plug having at least a pair of electrically conducting pins and a passive pin which are simultaneously receivable in respective sockets of an existing electrical outlet, which includes the steps of inserting the conducting pins and the passive pin into their respective sockets to establish a power supply path along the cord to the appliance; and displacing a threaded screw lying in a threaded passage through the passive pin such that said threaded screw is interposed between a pair of displaceable elements that are located in a passage extending transversely through the passive pin such that two extremities at an outermost peripheral region of the passive pin are respectively defined and are held captive by constrictions in said extremities of said transverse passage, such that said pair of displaceable elements are urged apart until said pair of displaceable elements partially protrude beyond the respective constricted extremities of the transverse passage towards an adjacent portion of its associated socket in order to counteract extraction of the pins from their respective sockets.

15. The method according to claim 14, wherein said pair of displaceable elements are two metal spheres.

16. The method according to claim 14, wherein said threaded screw is lying in an axial, threaded passage extending from the plug end of the pin such that said threaded screw could be accessed at an angle perpendicular to the plug.

17. The method according to claim 14 which includes the further step of partially shielding an electrical switch associated with the electrical outlet in which the plug is inserted to permit selective access to the switch once the power supply path to the appliance has been established.

18. A plug for securing a continuous power supply path through an electrical cord to an electrical appliance, which includes an insulating body supporting at least a pair of electrically conducting pins for establishing a power supply path along the cord, and a passive pin spaced from the conductive pins, all pins being simultaneously receivable in respective sockets of an existing electrical outlet;

a passage extending transversely through the passive pin, such that two extremities at an outermost peripheral region of the passive pin are respectively defined;

a pair of displaceable elements lying captive between constricted extremities of said passage extending transversely through the passive pin; and a locking means on the passive pin, for laterally displacing said pair of displaceable elements in use, until said pair of displaceable elements protrude beyond an outer peripheral region of the passive pin towards an adjacent portion of its associated socket, thereby counteracting extraction of the conducting pins and the passive pin from their respective sockets.

19. The plug according to claim 18 in which the insulating body has a shielding means for partially shielding an electrical switch once the conducting pins and the passive pin are located in their respective sockets.

20. The plug according to claim 18, wherein the locking means includes a screw having a threaded shank terminating at a tip, the shank lying in a threaded bore in a passage through the passive pin, with the tip of the screw being located adjacent to each displaceable element to permit lateral displacement of each element as the screw advances into the bore.

21. The plug according to claim 20, wherein said threaded shank of said screw is lying in an axial, threaded passage extending from the plug end of the pin such that said threaded screw could be accessed at an angle perpendicular to the plug.

22. A passive pin for use on a plug for securing a continuous power supply path through an electrical cord to an appliance, which includes an elongate body which is receivable in a complementary socket of an electrical outlet;

a passage extending transversely through the passive pin such that two extremities at an outermost peripheral region of the passive pin are respectively defined;

a pair of displaceable elements lying between constricted extremities of said passage extending transversely through the passive pin; and locking means for laterally displacing each displaceable element in use until it bears against an inner surface of a frictional element, and urges the frictional element radially outward in relation to the body.

23. The pin according to claim 22, wherein the locking means includes a screw having a threaded shank terminating, at a tip, the shank lying in a threaded bore in a passage through the passive pin, with the tip of the screw being located adjacent to each displaceable element to permit lateral displacement of each element as the screw advances into the bore.

24. The pin according to claim 23, wherein said threaded shank of said screw is lying in an axial, threaded passage extending from the plug end of the pin such that said threaded screw could be accessed at an angle perpendicular to the plug.

* * * * *